US007543363B2

(12) United States Patent
Webber et al.

(10) Patent No.: US 7,543,363 B2
(45) Date of Patent: Jun. 9, 2009

(54) SEAT BELT BUCKLE FOR USE WITH PRETENSIONER

(75) Inventors: James L. Webber, Shelby Township, MI (US); David G. Hlavaty, Northville, MI (US)

(73) Assignee: Delphi Technologies, Inc., Troy, MI (US)

( * ) Notice: Subject to any disclaimer, the term of this patent is extended or adjusted under 35 U.S.C. 154(b) by 400 days.

(21) Appl. No.: 11/435,543

(22) Filed: May 17, 2006

(65) Prior Publication Data

US 2006/0265846 A1 Nov. 30, 2006

Related U.S. Application Data

(60) Provisional application No. 60/684,877, filed on May 26, 2005.

(51) Int. Cl.
*A44B 11/26* (2006.01)

(52) U.S. Cl. ..... 24/641; 24/633

(58) Field of Classification Search ..... 24/629, 24/633–650; 280/801.1, 806, 808
See application file for complete search history.

(56) References Cited

U.S. PATENT DOCUMENTS

| | | | | |
|---|---|---|---|---|
| 2,863,200 | A | 12/1958 | Miller et al. | |
| 3,698,657 | A | 10/1972 | Kirchhoff et al. | 242/107.4 |
| RE29,342 | E | 8/1977 | Barbe | 24/230 |
| 4,151,967 | A | 5/1979 | Lindblad | 242/107.4 R |
| 4,358,878 | A | 11/1982 | Seel | 24/230 |
| 4,454,634 | A | 6/1984 | Haglund et al. | 24/636 |
| 4,705,296 | A | 11/1987 | Andersson et al. | 280/806 |
| 4,870,726 | A | 10/1989 | Eksell et al. | 24/636 |
| 4,972,559 | A | 11/1990 | Haglund | 24/637 |

(Continued)

FOREIGN PATENT DOCUMENTS

| | | |
|---|---|---|
| DE | G 92 02 525.0 | 2/1992 |

(Continued)

*Primary Examiner*—Robert J Sandy
*Assistant Examiner*—Ruth C Rodriguez
(74) *Attorney, Agent, or Firm*—Douglas D. Fekete

(57) ABSTRACT

A seat belt buckle for use with a tongue of a seat belt, the seat belt buckle comprising: a frame portion; a latch being movably mounted to the frame portion for movement between a first position and a second position, the latch being configured to engage a portion of the tongue as the latch moves from the first position to the second position; an ejector being slidably mounted to the frame portion for movement between a locking position and a release position, wherein movement toward the release position causes an opening force to be applied to the latch in order to move the latch from the second position towards the first position, wherein movement of the ejector towards the release position is caused by movement of a release button movably mounted to the seat belt buckle; an inertia locking device rotatably mounted to the release button for movement between a blocking position and an unblocking position, the inertia locking device being configured for rotation in a plane substantially parallel to a plane of movement of the latch, wherein a portion of the inertia locking device makes contact with the frame and prevents movement of the release button when the inertia locking device is in the blocking position; and a pair of springs integrally formed with the release button, the pair of springs being configured to provide a biasing force to the inertia locking device.

16 Claims, 5 Drawing Sheets

U.S. PATENT DOCUMENTS

| | | | | |
|---|---|---|---|---|
| 5,008,989 | A | 4/1991 | Wedler et al. | 24/641 |
| 5,029,369 | A | 7/1991 | Oberhardt et al. | 24/633 |
| 5,054,171 | A | 10/1991 | Tanaka | 24/637 |
| 5,066,042 | A | 11/1991 | Fohl | 280/806 |
| 5,097,571 | A | 3/1992 | Fohl | 24/641 |
| 5,115,543 | A | 5/1992 | Fohl | 24/633 |
| 5,119,532 | A | 6/1992 | Tanaka | 24/641 |
| 5,133,115 | A | 7/1992 | Bock | 24/633 |
| 5,142,749 | A | 9/1992 | Biller | 24/636 |
| 5,159,732 | A | 11/1992 | Burke | 24/641 |
| 5,195,224 | A | 3/1993 | Bock et al. | 24/641 |
| 5,211,447 | A | 5/1993 | Sedlmayer et al. | 297/468 |
| 5,213,365 | A | 5/1993 | Fohl | 280/806 |
| 5,216,788 | A | 6/1993 | Bock | 24/633 |
| 5,280,669 | A | 1/1994 | Nanbu et al. | 24/641 |
| 5,309,611 | A | 5/1994 | Wier et al. | 24/633 |
| 5,341,546 | A | 8/1994 | Burke | 24/641 |
| 5,357,658 | A | 10/1994 | Tanaka | 24/641 |
| 5,369,855 | A | 12/1994 | Tokugawa | 24/641 |
| 5,373,612 | A | 12/1994 | Kopetzky | 24/637 |
| 5,496,068 | A | 3/1996 | Ball et al. | 280/806 |
| 5,522,619 | A | 6/1996 | Collins | 280/806 |
| 5,555,609 | A | 9/1996 | Tolfsen et al. | 24/641 |
| 5,566,431 | A | 10/1996 | Haglund | 24/633 |
| 5,595,400 | A | 1/1997 | Wier | 280/806 |
| 5,596,795 | A | 1/1997 | Beisswenger | 24/633 |
| 5,649,341 | A | 7/1997 | Ashline et al. | 24/171 |
| 5,704,099 | A | 1/1998 | Cahill | 24/633 |
| 5,742,987 | A | 4/1998 | Mikulec et al. | 24/641 |
| 5,765,266 | A | 6/1998 | Betz | 24/633 |
| 5,781,971 | A | 7/1998 | Petersen, III | 24/633 |
| 5,839,174 | A | 11/1998 | Chamings et al. | 24/633 |
| 5,974,638 | A | 11/1999 | Yamaguchi et al. | 24/633 |
| 5,996,193 | A | 12/1999 | Gill et al. | 24/641 |
| 6,170,134 | B1 | 1/2001 | Downie et al. | 24/641 |
| 6,205,628 | B1 | 3/2001 | Downie | 24/633 |
| 6,233,794 | B1 | 5/2001 | Kohlndorfer et al. | 26/641 |
| 6,266,855 | B1 | 7/2001 | Specht et al. | 24/633 |
| 6,340,176 | B1 | 1/2002 | Webber et al. | 280/806 |
| 6,367,129 | B1 | 4/2002 | Mori | 26/641 |
| 6,370,742 | B1 | 4/2002 | Yamaguchi et al. | 24/641 |
| 6,427,297 | B1 | 8/2002 | Yamaguchi et al. | |
| 6,438,810 | B2 | 8/2002 | Rogers et al. | 24/641 |
| 6,513,747 | B1 | 2/2003 | Lee et al. | 242/374 |
| 6,539,595 | B1 | 4/2003 | Benedict | 24/633 |
| 6,550,112 | B2 | 4/2003 | Röhrle et al. | 24/641 |
| 6,550,867 | B2 | 4/2003 | Rogers, Jr. et al. | 297/468 |
| 6,572,147 | B2 | 6/2003 | Webber et al. | 280/806 |
| 6,588,077 | B2 | 7/2003 | Katsuyama et al. | 24/641 |
| 6,701,587 | B1 | 3/2004 | Sato | 24/633 |
| 6,725,509 | B1 | 4/2004 | Lee et al. | 24/641 |
| 6,746,048 | B2 * | 6/2004 | Tajima et al. | 24/641 |
| 7,124,480 | B2 * | 10/2006 | Kawai et al. | 24/641 |
| 2001/0037544 | A1 | 11/2001 | Rogers, Jr. et al. | |

FOREIGN PATENT DOCUMENTS

| | | |
|---|---|---|
| DE | G92 02 526.9 | 2/1992 |
| EP | 0 231 336 B1 | 12/1987 |
| EP | 0368 277 | 5/1990 |
| EP | 0 384 703 | 8/1990 |
| EP | 0 384 703 B1 | 8/1990 |
| EP | 0 559 403 | 9/1993 |
| EP | 0 557 983 B1 | 8/1996 |
| EP | 0 868 860 | 10/1998 |
| EP | 0 943 252 | 9/1999 |
| GB | 2 227 513 A | 8/1990 |
| GB | 2 249 806 A | 5/1992 |
| WO | WO 87/00736 | 2/1987 |
| WO | WO 90/10397 | 9/1990 |

* cited by examiner

SEAT BELT BUCKLE FOR USE WITH PRETENSIONER

CROSS REFERENCE TO RELATED APPLICATIONS

This application claims the benefit of U.S. Provisional Patent Application Ser. No. 60/684,877, filed May 26, 2005, the contents of which are incorporated herein by reference thereto.

TECHNICAL FIELD

This present invention relates generally to a seat belt buckle and more specifically, the present invention relates to a seat belt buckle for use with a seat belt pretensioner.

BACKGROUND

Seat belt buckles in general must meet many requirements to reliably operate under any and all conditions. One specific requirement for seat belt buckles is to function when used with seat belt pretensioners (i.e., retractor, buckle or anchor pretensioners).

Seat belt pretensioners remove seat belt slack in the event of a predetermined occurrence. When pretensioners are activated this results in a very high acceleration of the webbing and subsequently, the seat belt buckle. An example of a pretensioner is a pyrotechnically actuatable device, which fires a squib wherein a resulting force will remove a predetermined amount of slack from the seat belt webbing secured to the seat belt buckle. Accordingly, and when pretensioners are activated, the seat belt buckle is subjected to a very high acceleration.

Therefore, it is desirable to provide the seat belt buckle with a locking feature or device that is engaged during activation of the pretensioners wherein movement of the release button is limited. Additionally, it is desirable to provide a seat belt buckle with an inertia locking device to maintain a latched condition during activation of the pretensioners.

SUMMARY

Disclosed herein is a seat belt buckle for use with a tongue of a seat belt. The seat belt buckle of the exemplary embodiment comprises: a frame portion; a latch being movably mounted to the frame portion for movement between a first position and a second position, the latch being configured to engage a portion of the tongue inserted into the frame as the latch moves from the first position to the second position; an ejector being slidably mounted to the frame portion for movement between a locking position and a release position, wherein movement toward the release position causes an opening force to be applied to the latch in order to move the latch from the second position towards the first position, wherein movement of the ejector towards the release position is caused by movement of a release button movably mounted to the seat belt buckle; an inertia locking device rotatably mounted to the release button for movement between a blocking position and an unblocking position, the inertia locking device being configured for rotation in a plane substantially parallel to a plane of movement of the latch, wherein a portion of the inertia locking device makes contact with the frame and prevents movement of the release button when the inertia locking device is in the blocking position; and a pair of springs integrally formed with the release button, the pair of springs being configured to provide a biasing force to the inertia locking device to rotate the inertia locking device to the unblocking position.

In another exemplary embodiment, a method for limiting acceleration forces applied to a release mechanism of a seat belt buckle is provided, the method comprising: rotatably mounting a mass to a release button of the seat belt buckle by inserting a lobed portion into a receiving area of the release button and positioning a pin of the mass into a pair of openings in the release button, the pin being biased in a first position by a pair of springs integrally formed with the release button, wherein the first position allows the pin to travel through a pair of slots in a frame of the seat belt buckle as the release button is slidably moved with respect to the frame from a locked position to an unlocked position wherein the release button causes a force to be applied to an ejector as the release button moves to the unlocked position and wherein the pin prevents movement of the release button from the locked position to the unlocked position when the mass is rotated from the first position and the pin makes contact with a surface of the frame.

Also disclosed herein is a restraint system for a vehicle. A restraint system for a vehicle, comprising: a seat belt buckle for use with a tongue of a seat belt, the seat belt buckle comprising: a frame portion; a latch being movably mounted to the frame portion for movement between a first position and a second position, the latch being configured to engage a portion of the tongue inserted into the frame as the latch moves from the first position to the second position; an ejector being slidably mounted to the frame portion for movement between a locking position and a release position, wherein movement toward the release position causes an opening force to be applied to the latch in order to move the latch from the second position towards the first position, wherein movement of the ejector towards the release position is caused by movement of a release button movably mounted to the seat belt buckle; an inertia locking device rotatably mounted to the release button for movement between a blocking position and an unblocking position, the inertia locking device being configured for rotation in a plane substantially parallel to a plane of movement of the latch, wherein a portion of the inertia locking device makes contact with the frame and prevents movement of the release button when the inertia locking device is in the blocking position; a pair of springs integrally formed with the release button, the pair of springs being configured to provide a biasing force to the inertia locking device to rotate the inertia locking device to the unblocking position; and a pre-tensioning device for removing slack from the seat belt in accordance with a predetermined event.

In another exemplary embodiment, a release button for use with a seat belt buckle is provided. The release-button comprising: a mass rotatably mounted to the release button for movement between a blocking position and a non-blocking position; a pin depending outwardly from opposite sides of the mass; a pair of receiving areas configured to receive the pin depending outwardly from the mass; a pair of springs integrally molded with the release button, the pair of springs providing a biasing force to rotate the mass into the non-blocking position; and wherein the biasing force must be overcome for the mass to rotate into the blocking position.

The above-described and other features of the present disclosure will be appreciated and understood by those skilled in the art from the following detailed description, drawings, and appended claims.

DRAWINGS

Figure 5:
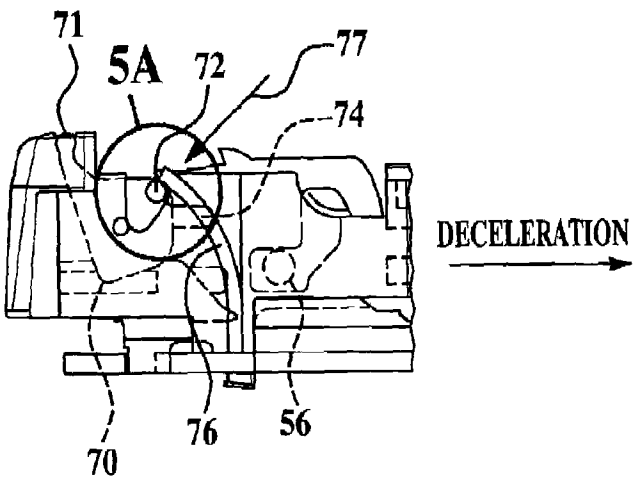
Figure 5B:
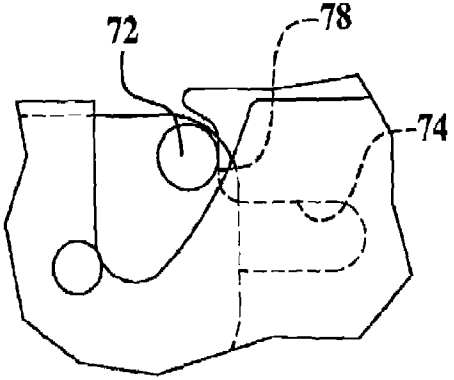
Figure 5A:
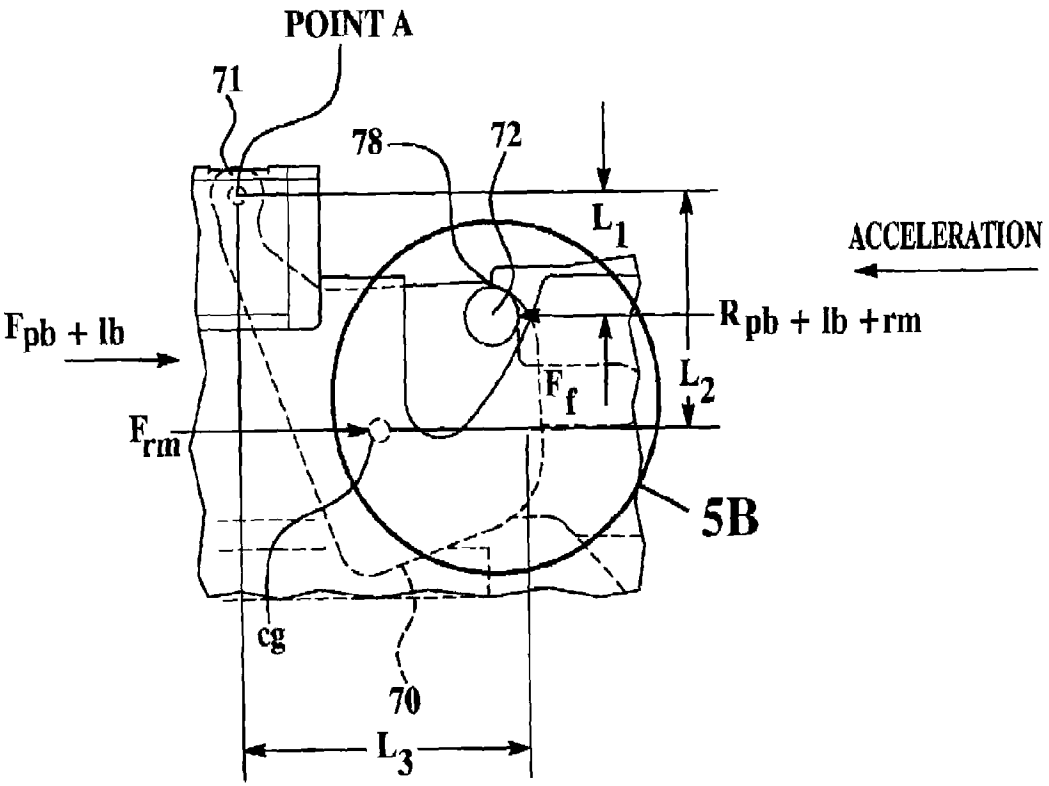
Figure 6:
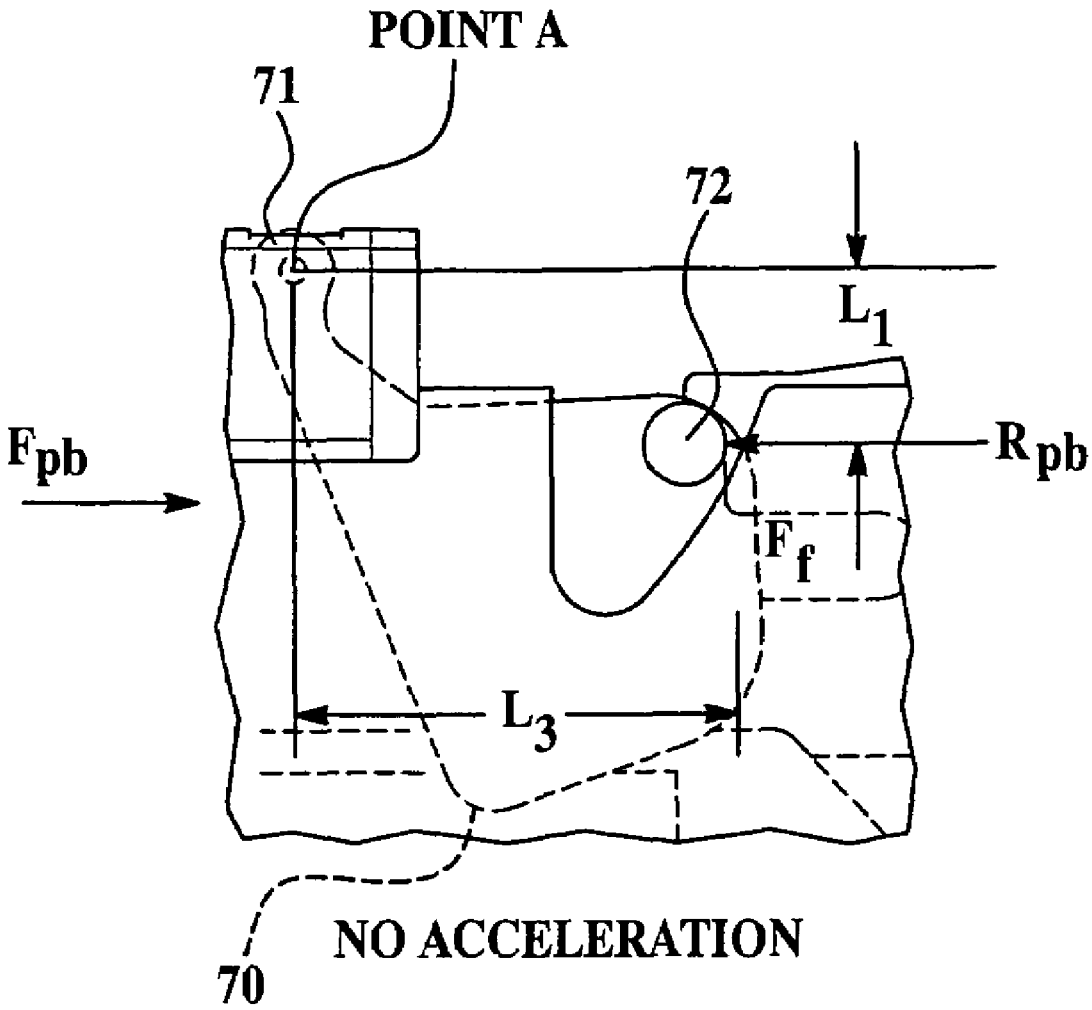

FIGS. 5, 5A, and 5B illustrate a blockout operation of the inertia locking device of exemplary embodiments of the present invention; and FIG. 6 illustrates a cam out operation of the inertia locking device of exemplary embodiments of the present invention.

DESCRIPTION OF EXEMPLARY EMBODIMENTS

Disclosed herein is a seat belt buckle for use with a pre-tensioning device. When activated, the pre-tensioning device removes slack from a seat belt or retracts a predetermined amount of seat belt webbing, which is secured to either the seat belt buckle or a tongue of a seat belt. The present invention is also related to commonly owned and assigned U.S. patent application Ser. No. 10/945,308 filed Sep. 20, 2004, the contents of which are incorporated herein by reference thereto.

The seat belt buckle comprises a latch for securing a tongue of the seat belt to the seat belt buckle. The seat belt buckle further comprises a release button that actuates an ejector via a pin and a cantilever member pivotally mounted to the ejector. The ejector is slidably mounted to a frame portion of the seat belt buckle. The ejector is also configured to slide from a locking position to a release position, wherein insertion of the tongue in the seat belt buckle causes movement of the ejector towards the locking position and depression of the release button when the tongue is inserted in the seat belt buckle causes movement of the ejector from the locking position to the release position. In addition, movement of the ejector from the locking position to the release position causes an opening force via a lock bar, the cantilever and a spring to be applied to the latch in order to move the latch from a locking position towards an open position wherein the tongue portion of the seat belt is able to be removed from the seat belt buckle.

The seat belt buckle further comprises an inertia locking device or movable locking member rotatably mounted to the release button for movement between a locking or blocking position and an unlocking or unblocking position, wherein the inertia locking device prevents movement of the release button when the inertia locking device is in the locking position. The inertia locking device is biased or maintained into the unlocking position by a biasing force wherein the inertia locking device is capable of being rotated or moved into the locking position. In accordance with an exemplary embodiment, the inertia locking device is moved into the locking position when the seat belt buckle is subjected to a force that creates a moment in the locking device sufficient to overcome the biasing force applied to the inertia locking device by the spring members thereby causing rotational movement of the inertia locking device such that the pin member of the inertia locking device will make contact with the frame and prevent further movement of the release button.

In accordance with an exemplary embodiment, the inertia locking device via the spring members is moved or rotated back into the unlocking position when the seat belt buckle is no longer subjected to the force that creates the moment in the locking device which overcomes the biasing force of the spring members.

Moreover and in the event of the failure of the spring members providing the biasing force, the inertia locking device and the seat belt buckle frame are configured to allow the inertia locking to be rotated back into its unlocking position. This is achieved by providing cam out surfaces on the frame portion. Thus, and when the seat belt is no longer subject to the force, which creates the moment for rotating the inertia locking device the inertia locking device is capable of being moved back into its unlocking position even though spring members may no longer be in operation for providing the biasing force to the inertia locking device. In addition, and in accordance with an exemplary embodiment, the inertia locking device is configured to be affected or rotate in response to accelerations in two of three axes or directions.

Figure 1:
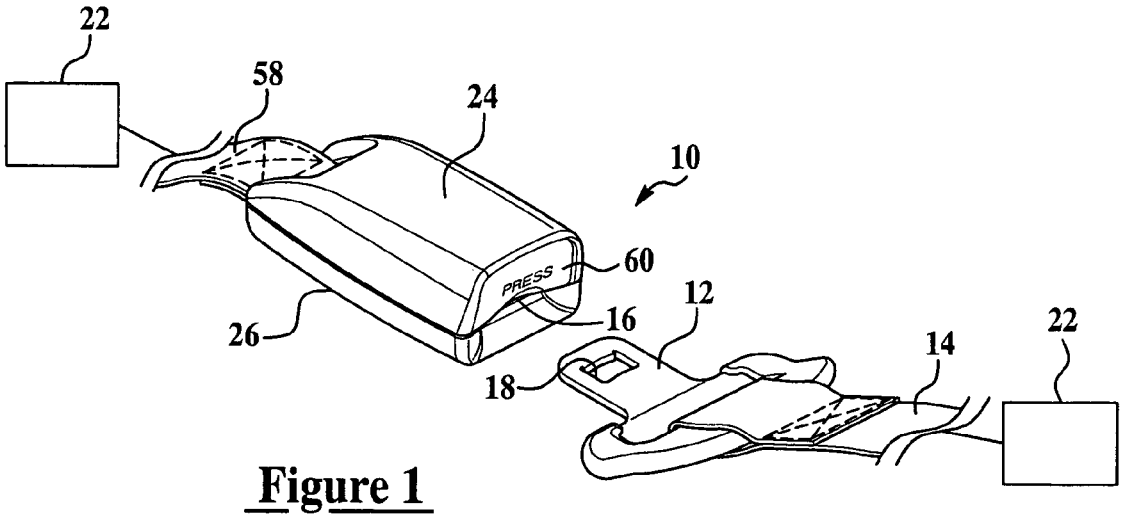
FIG. 1 is a perspective view of a seat belt buckle constructed in accordance with exemplary embodiments of the present invention.

Referring now to FIG. 1, a seat belt buckle 10 constructed in accordance with an exemplary embodiment of the present invention is illustrated. Seat belt buckle 10 is configured to receive and engage a tongue portion 12 connected to a seat belt webbing 14. The tongue portion 12 is received within an opening 16 of seat belt buckle 10. Upon insertion of tongue portion 12 into opening 16, a latch 32 of the buckle engages an opening 18 of tongue portion 12. In order to release the tongue portion from seat belt buckle 10, a release button 60 is depressed and tongue portion 12 is ejected from seat belt buckle 10.

Seat belt buckle 10 and/or tongue portion 12 is also secured to a pre-tensioning mechanism 22 (illustrated schematically by box 22), which in accordance with a predetermined activation event will cause the pre-tensioning mechanism to remove the slack from the seat belt webbing. As illustrated, the pre-tensioning mechanism may be secured to either the seat belt webbing of the tongue portion or the webbing securing the belt buckle to the vehicle or both. Non-limiting examples of pretensioning mechanisms (e.g., retractors and pretensioners for seat belt buckles, seat belts and seat belt anchors) are found in the following U.S. Pat. Nos. 6,340,176; 6,513,747; and 6,572,147 the contents of which are incorporated herein by reference thereto. U.S. Pat. No. 6,725,509, also incorporated herein by reference thereto, illustrates a seat belt buckle. U.S. Pat. No. 6,438,810 also incorporated herein by reference thereto, illustrates a seat restraint buckle assembly also designed for use with seat belt pretensioners that when deployed will cause the seat belt buckle to experience very high accelerations and very rapid decelerations. In one contemplated configuration for use with exemplary embodiments of the present invention, a pyrotechnically activated pre-tensioning device is secured to the seat belt buckle while a retractor is secured to the webbing having tongue portion 12 secured thereto. For example, the retractor may be located at the shoulder of the vehicle occupant while the pre-tensioner is disposed proximate to the vehicle floor panel where the seat is secured thereto.

Figure 2:
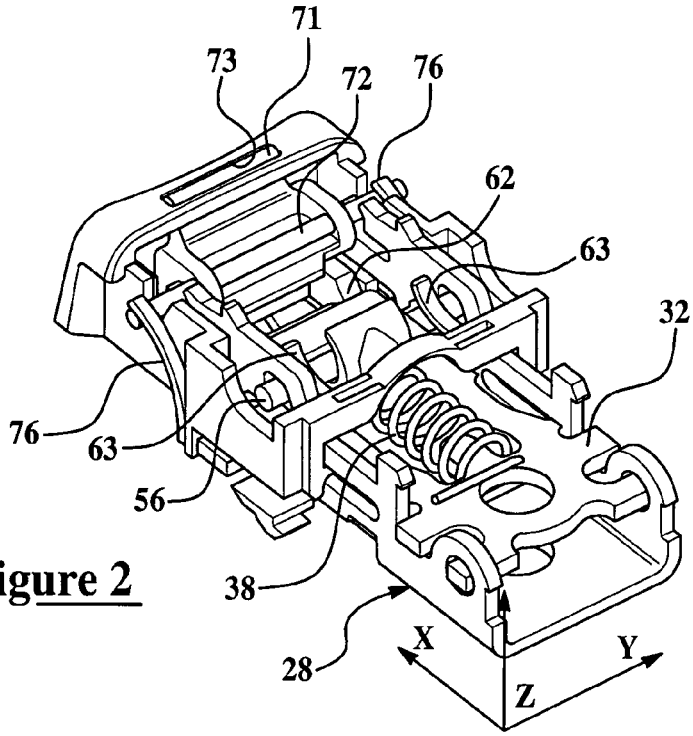
FIG. 2 is a perspective view of a seat belt buckle constructed in accordance with exemplary embodiments of the present invention.
Figure 3:
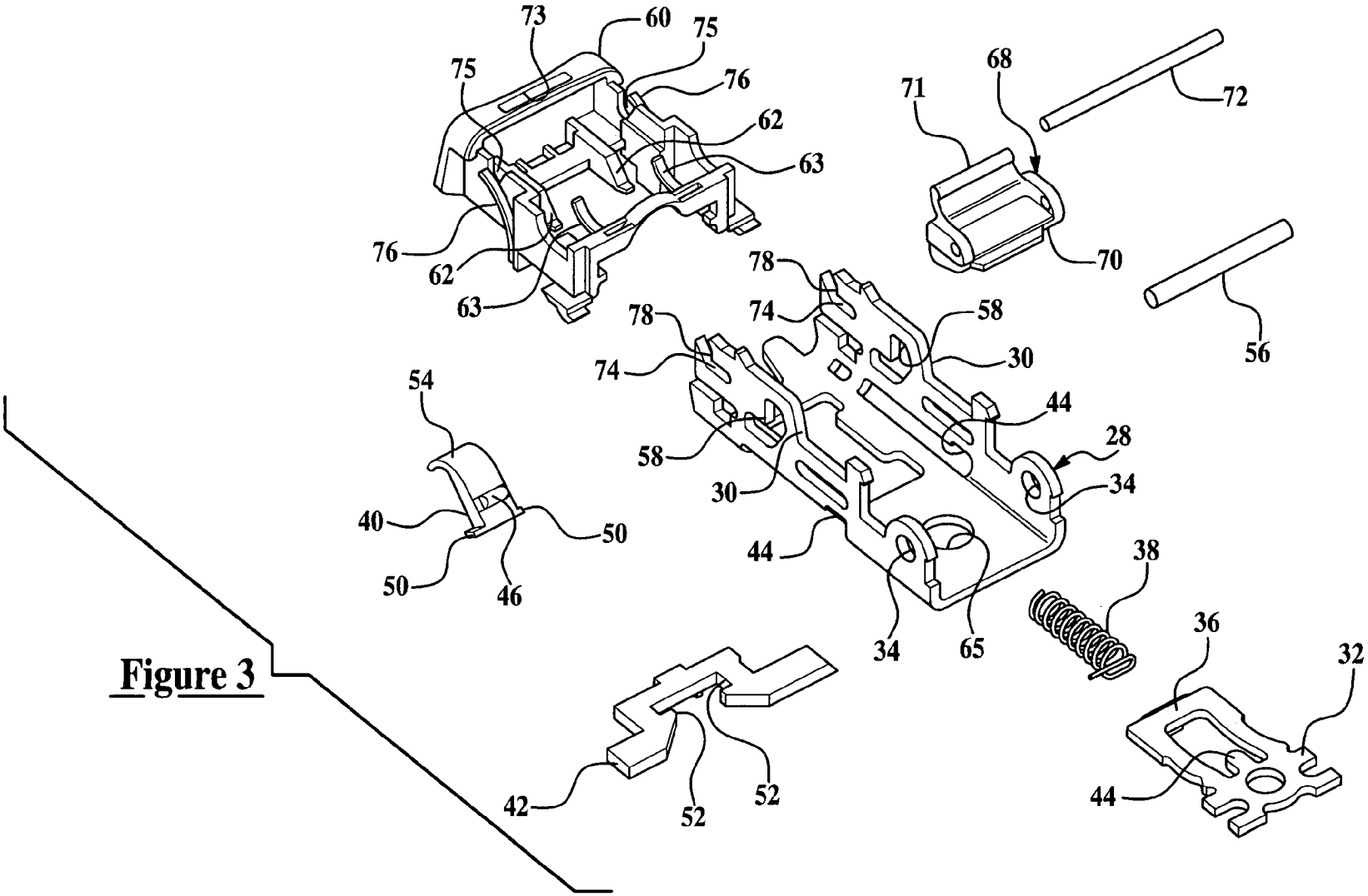
FIG. 3 is an exploded view of a seat belt buckle constructed in accordance with exemplary embodiments of the present invention.
Figure 4A:
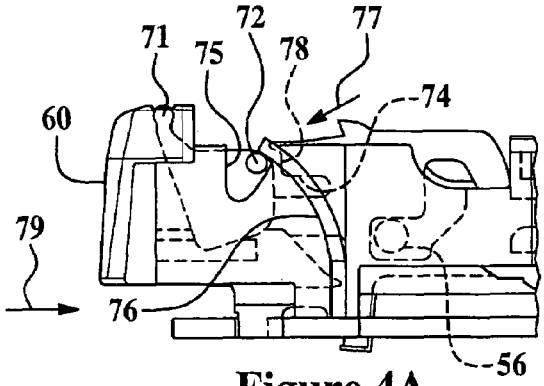
FIGS. 4A-4G illustrate operation of a seat belt buckle constructed in accordance with exemplary embodiments of the present invention.
Figure 4B:
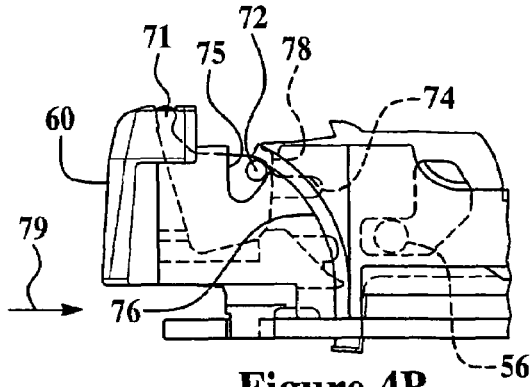
Figure 4C:
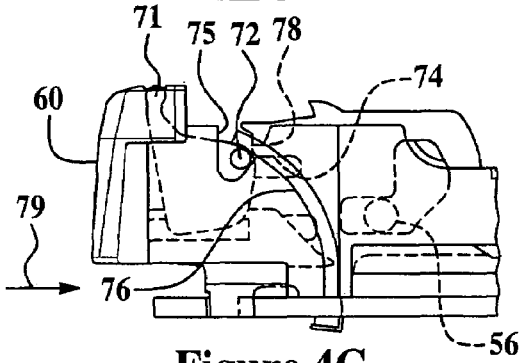
Figure 4D:
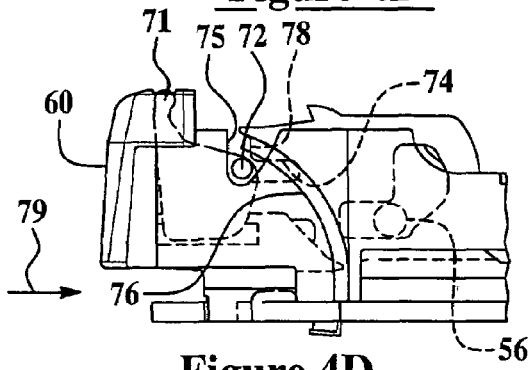
Figure 4E:
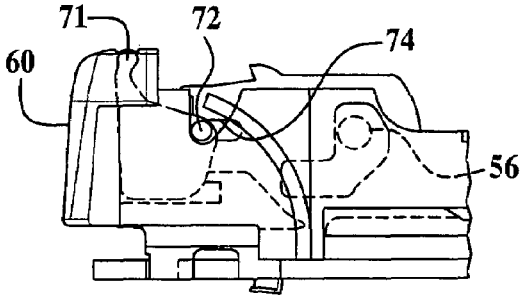
Figure 4F:
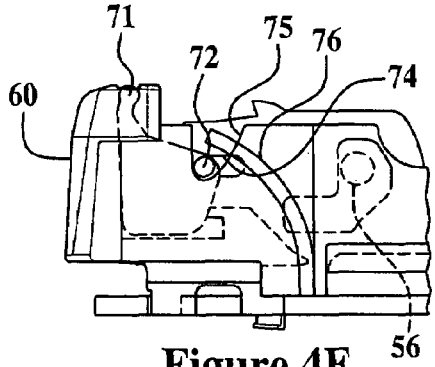
Figure 4G:
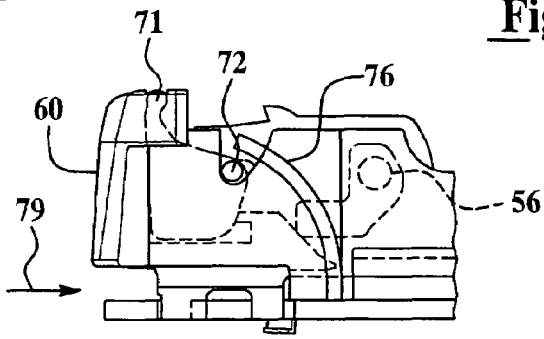

As illustrated, seat belt buckle 10 comprises an upper housing portion 24 and a lower housing portion 26 and a frame portion 28 received therein. Referring now to FIGS. 2 and 3, component parts of a seat belt buckle constructed in accordance with exemplary embodiments of the present invention are illustrated. FIG. 3 illustrates an exploded view of the seat belt buckle. As illustrated, seat belt buckle 10 comprises a frame portion 28. Frame portion 28 is configured to have a pair of sidewalls 30, which are configured to rotatably receive and engage a latch 32. Latch or latch portion 32 is configured to be received within a pair of openings 34 in sidewalls 30. Latch portion 32 further comprises a latching member 36 configured to engage opening 18 of tongue portion 12 as it is slid into belt buckle 10.

In order to rotate latch 32 into an unlocking position, a spring 38 is positioned between latch 32 and a cantilever 40. Cantilever 40 is pivotally mounted to an ejector 42 slidably received within a pair of the elongated openings 44 disposed in sidewalls 30. Spring 38 is positioned upon a protrusion 44 of latch 32 and a protrusion 46 of cantilever 40. During insertion of the tongue of the seat belt into the frame, the ejector is slid within elongated openings 44 and spring 38 is compressed thereby providing an urging force to cantilever 46 wherein cantilever 46 is rotated about its pivot pins 50, which are rotatably received in complimentary openings 52 in ejector 42.

As cantilever 40 is rotated an arm portion 54 of cantilever 40 urges a lock bar 56 to travel through slots 58 in sidewalls 30. In accordance with an exemplary embodiment slots 58 are "L" shaped to guide the lock bar into its release and locking positions. Of course, other configurations are contemplated to be within the scope of exemplary embodiments of the present invention. Upon insertion of tongue portion 12 into belt buckle 10, ejector 42 is longitudinally slid with respect to frame portion 28 and accordingly spring 38, which is disposed between cantilever 40 and latch 32, is compressed as the tongue portion is slid into the frame portion 28. During this movement latch 32 is rotated into an engaging position via lock bar or pin 56 such that tongue portion 12 is secured within belt buckle 10.

Thus, once the tongue is inserted into the frame of the buckle the tongue contacts and depresses the ejector, which compresses and stores energy in the spring. As the tongue depresses the ejector the latch will rotate through an aperture in the tongue. As the latch is rotated into the latched position the stored energy in the spring translates the lock bar in the slots of the frame to hold the latch in a latched state.

In order to eject or provide an urging force to slide tongue portion 12 out of the belt buckle, ejector 42, which is slidably mounted to frame portion 28 is configured to make contact with a distal end of tongue portion 12 as the same is being inserted into opening 16 of belt buckle 10. In order to slide lock bar 56 within openings 58 and ultimately move latch 32 into its release position, a release button 60 is configured to slidably engage sidewalls 30 while also providing a release force to lock bar 56, via a pair of integral cam surfaces 62. Thus, as release button 60 is depressed, an urging force is applied to the lock bar to slide it in openings 58. This movement will cause an urging force to be applied to the cantilever via lock bar 56 wherein cantilever 40 will rotate and compress spring 38. This movement allows the lock bar to be moved upwardly wherein latch 32 is free to pivot upwardly moving latch portion 36 out of opening 18 and ejector 42 is slid within openings 44 via the spring force of spring 38 thus, tongue 12 is ejected out of the buckle. In addition, the release button is configured to have a pair of cantilevered arms 63 each of which comprises a cam surface for contacting lock bar 56 when the latch is pushed upwardly and the tongue is removed from the seat belt buckle. In accordance with an exemplary embodiment, arms 63 provide a slight contact force to lock bar 56 in order to provide an anti-rattling feature.

Frame portion 28 further comprises an opening 65 in order to facilitate securement of a webbing material 64 that operably connects seat belt buckle 10 to a pre-tensioning mechanism 22. Normal operation or operation without the pretensioner being activated is illustrated in FIGS. 4A-4G.

In order to provide undesired movement of the lock bar within openings 58 (e.g., movement that is not attributable to depression of release button 60 by an individual or other person who is using the seat belt secured thereto namely, the activation of a pre-tensioning device) an inertia locking device 68 is movably or rotatably secured to release button 60. In exemplary embodiment, inertia locking device 68 comprises a rotating mass 70 pivotally secured to release button 60. In accordance with an exemplary embodiment the rotating mass is pivotally mounted to the release button by a lobe portion or integral pin portion 71 that is rotatably received or snapped into a receiving portion 73 of the release button. As illustrated, receiving portion 73 comprises an elongated opening for pivotally receiving pin portion 71 therein. Of course receiving portion 73 may have other configurations depending on the configuration of the lobe portion or integral pin portion 71 of the rotating mass.

In addition, a pin 72 is secured to mass 70. Pin 72 extends outwardly from either side of mass 70 and has its end portions received within openings 74 of the frame portion and openings 75 of the release button. Acting upon the end portions of the pin are a pair of biasing members or leaf springs 76. In accordance with an exemplary embodiment, leaf springs 76 are integrally formed with the release button. Leaf springs 76 are integrally formed with and thus secured to a side wall portion of the release button at one end and a freely movable portion at the other end. Leaf springs 76 are also configured to provide a biasing force in the direction of arrow 77 thus, pin 72 is urged downwardly in openings 75 such that during operator activation of release button 60 (e.g., depression of the release button in the direction of arrow 79) pin 72 is aligned with and will travel linearly within openings or slots 74 of the frame portion. In an exemplary embodiment, the mass is biased into an unblocking position via an urging force applied to pin 72 via leaf springs 76.

In addition, and when the mass and the pin are in the unblocking position more than 50 percent of the diameter of the pin is aligned or positioned with respect to opening 74 such that movement of the release button in the direction of arrow 79 will urge pin 72 into opening 75 (e.g., the curved surface of the pin corresponding to less than half of the diameter of the pin will allow the same to travel into the opening). Of course, other configurations and percentages of pin 72 for facilitating movement of the pin into opening 75 are contemplated to be within the scope of exemplary embodiments of the present invention. In addition, mass 70 may be configured to have a portion depending away from either side, wherein the integral portion is configured to be biased by springs 76 and travel through openings 74 and 75 as well as make contact with cam surface 78.

In accordance with an exemplary embodiment and as a release force is applied to the release button, the release button translates in a linear direction with respect to the frame. During this linear movement, the pin mounted to the rotating mass passes through two pairs of control apertures or openings—one pair being located in the frame and the other being located in the release button. As the release button is depressed the control apertures integral with the release button and the leaf springs react against the pin and cams the rotating mass to a neutral position (e.g., the position illustrated in FIGS. 4A and 4B). Leaf springs 76 provide a biasing force to pin 72 and mass 70 such that the same is biased in the neutral position, which also provides an anti-rattle feature wherein the pin and mass are prevented from rattling as they are held in contact with the release button as well as the frame. This is provided by configuring the mass such that the center of the mass is at a point where the springs will make contact with the pin when the release button is not being activated or depressed (e.g., a neutral position or unblocking or unlocking position of the mass). Moreover, the center of gravity of the mass is positioned so that it is not aligned with a pivot point of the mass with respect to the button (see FIG. 5 wherein the center of gravity of the mass is illustrated as "cg"). Finally, and as will be shown by the formulas below, the mass of the inertia locking device, and the location of its center of gravity with respect to its pivot point to the release button when compared to the mass and center of gravity of the push button or release button will cause the mass to overcome the biasing force of the leaf springs and rotate into the locking position prior to linear movement of the release button that would create or cause an unlatching of the seat belt buckle. Thus, the mass and pin 72 will rotate into the blocking or locking position when the seat belt buckle is subject to accelerations attributable to the activation of the pretensioners secured to the seat belt buckle.

FIGS. 4A-4G illustrate normal operation of seat belt buckle 10 while FIG. 5 illustrates the rotating mass block out theory of an exemplary embodiment of the present invention and FIG. 6 illustrates a cam out feature of an exemplary embodiment of the present invention.

As illustrated in FIGS. 4A-4G, the depression of release button 60 in the direction of arrow 79 is shown, which in this example is attributable to an operator depressing button 60 with their fingers in order to release the latch of the seat belt. As release button 60 is depressed, pin 72 which depends outwardly from either side of mass 70, travels through the slotted openings in frame 28. During this operation the pin will first make contact with a cam surface 78 and then travel downwardly with a corresponding rotation of mass 70. In addition, the biasing force of the biasing springs in the direction of arrow 77 will also guide pin 72 or rotate mass 70 such that pin 72 will travel downwardly first (FIGS. 4A and 4B) and then linearly in openings 74.

Thereafter, and as mass 70 has rotated slightly clockwise pin 72 will no longer make contact with spring 76 and travel in opening 74 in the direction of arrow 79. The lack of contact of spring 76 will prevent any unnecessary frictional forces caused by pin 72 making contact with the edges of opening 74 as the pin travels therethrough (FIGS. 4C-4G).

After the rotation of the mass, the biasing force of leaf springs 76 will define an uncompressed position of springs 76 wherein pin 72 and spring 76 are spaced from each other. Thereafter, the pin and button 60 with mass 70 will travel linearly in the direction of arrow 79 until the latch is released and the tongue is ejected from the seat belt buckle.

In accordance with an exemplary embodiment and referring now to FIG. 5 and when a retractor or anchor pretensioner is activated, the seat belt webbing attached to the tongue is pulled towards the retractor or anchor at a very high acceleration. Since the tongue described above is connected to the latch and subsequently the frame, the frame is displaced relative to the release button and the lock bar creates inertia forces on the release button and the lock bar. These combined inertia forces will act on the release button and cause the same to translate toward an unlatched condition (e.g., in the direction of arrow 79). However, and during this same high acceleration event and as viewed in FIG. 5, the rotating mass will rotate or pivot counter clockwise with respect to the release button wherein the biasing force of the leaf springs in the direction of arrow 77 is overcome and pin 72 and mass 70 rotate so as to align pin 72 with cam surface 78 of the frame. In accordance with an exemplary embodiment, mass 70, pin 72 and spring 76 are each configured to cause pin 72 to be aligned with surface 78 (e.g., a blocking or locking position) prior to release button 60 moving a sufficient distance in the direction of arrow 79 that would cause pin 72 to travel in opening 74 towards an unlocking position. In other words and in the blocking position, more than 50% of the diameter of the pin is positioned to make contact with the surface of the frame proximate to opening 74. See also FIG. 5B (e.g., blocking or locking position), wherein the spring is removed from the drawing to clearly illustrate the pin making contact with surface 78.

In accordance with an exemplary embodiment, the inertia forces acting on the seat belt buckle due the pre-tensioning devices will also act on the rotating mass. As such, the rotating mass will rotate into a blockout position with respect to the control apertures (e.g., openings 74) integral with the frame. Since the lock bar acts in conjunction with the release button, a latched state of the buckle will be maintained by preventing translation of the release button in the direction of arrow 79.

In accordance with an exemplary embodiment openings 75 of the release button are slotted openings or channels having an open top and a nearly vertical edge facing an angularly positioned edge, wherein the angular positioned edge is located closer to the spring members and the cam surfaces in order to facilitate the movement of pin 72 therein. Also, and in accordance with an exemplary embodiment release button 60 is formed from an easily molded material such as plastic thus biasing members or springs 76 are also plastic and integrally molded therewith.

The inertia blockout of the release button and lock bar is maintained because inertia forces acting on the rotating mass are greater than the inertia forces tending to force the pin out of the blockout position (e.g., movement away from the cam surface).

In accordance with an exemplary embodiment, the mass will have a center of gravity substantially below a rotating mass pivot point or the securement point of the rotating mass to the release button.

During activation of the pretensioner, the seat belt buckle experiences acceleration in all three axes X, Y & Z (illustrated in FIG. 1), therefore the blockout feature must operate under accelerations in all three axes. In accordance with an exemplary embodiment, the rotating mass is configured for movement or rotation in a plane substantially parallel to a plane of movement of the latch, wherein a portion of the inertia locking device makes contact with the frame and prevents movement of the release button when the inertia locking device is in the blocking position. Accordingly, exemplary embodiments of the present invention are sensitive to accelerations in the X and Z axes only and eliminates sensitivity to accelerations in the Y axis. In other words, an acceleration in the X and Z axes will cause movement of the mass relative to the frame while acceleration in the Y axes will not cause rotation of the inertia locking device or movement of release button 60.

Thus, and when belt buckle 10 is subjected to a force, which creates a moment in inertia locking device 68, mass 70 and the ends of pin 72 overcome the biasing force of springs 76 and rotate into a locking position wherein the ends of pin 72 make contact with cam surfaces 78 of the frame portion and movement of the release button is prevented. Thus, unwanted movement of latch 32 will not occur. This feature is illustrated in FIG. 5.

In accordance with an exemplary embodiment, the rotating mass blockout theory is explained as follows, wherein:

$F_f$=Frictional Force $F_{rm}$=Force of Rotating Mass $R_{pb+lb+rm}$=Reaction Force of the Push Button+Lock Bar+Rotating Mass $F_{pb+lb}$=Force Pushbutton+Lock Bar $$\Sigma M_a=0=+M_1-M_2-M_3$$

$$M_1<M_2+M_3$$

$$R_{pb+lb+rm}\times L_1<F_{rm}\times L_2+F_f\times L_3$$

In accordance with an exemplary embodiment $M_1<M_2+M_3$ thus, the mass will rotate into the blocking position.

Accordingly, and as shown in the above example, the inertia forces will rotate the mass into the blockout position illustrated in FIG. 5, when $M_2+M_3$ is greater than $M_1$. As such, exemplary embodiments are configured so that the sensitivity of the mass to accelerations in the X-direction (FIG. 1) are significant enough to overcome rotation of the buckle or Z-direction accelerations (FIG. 1).

It is also noted that cam or contact surfaces 78 are configured to have a cam out feature in the event of a failure of the leaf springs. Thus, a fail-safe mode of operation is provided. For example, after a pretensioner has been deployed, the occupant must be able to operate the release button and detach the buckle. In the event of a leaf spring failure, the frame's openings are designed with a positive cam-out feature, wherein and as the release button is depressed the cam surface of the frame will make contact with the pin and urge the rotating mass downwardly so pin 72 can travel in opening 74. As a force on the release button is increased, the forces acting on the rotating mass pin will increase to the point sufficient to overcome the friction forces and the ramp angle of the cam surfaces 78 of the frame portion will cause the rotating mass and pin 72 to translate out of the blockout position. This feature is illustrated in FIG. 6.

In accordance with an exemplary embodiment, the cam out theory may be explained as follows:

In order to provide cam-out in the event of leaf spring failure the Force of the push button must be greater than the Frictional Force $F_{pb}>F_f$.

$$\Sigma M_a=0=M_1-M_3$$

$$M_1>M_3$$

$$R_{pb}\times L_1>F_f\times L_3$$

$$R_{pb}\times L_1>0.2\times(R_{pb})\times L_3$$

In the case of spring failure (integral leaf springs), the frame cutout or surface 78 will provide a cam-out when the pushbutton force is sufficient to overcome the opposing friction forces.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A seat belt buckle for use with a tongue of a seat belt, the seat belt buckle comprising:

a frame portion;

a latch being movably mounted to the frame portion for movement between a first position and a second position, the latch being configured to engage a portion of the tongue inserted into the frame as the latch moves from the first position to the second position; an ejector being slidably mounted to the frame portion for movement between a locking position and a release position, wherein movement toward the release position causes an opening force to be applied to the latch in order to move the latch from the second position towards the first position, wherein movement of the ejector towards the release position is caused by movement of a release button movably mounted to the seat belt buckle;

an inertia locking device rotatably mounted to the release button for movement between a blocking position and an unblocking position, the inertia locking device being configured for rotation in a plane substantially parallel to a plane of movement of the latch, wherein a portion of the inertia locking device makes contact with the frame and prevents movement of the release button when the inertia locking device is in the blocking position; and a pair of springs integrally formed with the release button, the pair of springs being configured to provide a biasing force to the inertia locking device to rotate the inertia locking device to the unblocking position;

wherein the inertia locking device comprises a mass rotatably mounted to the release button by a lobed portion that is rotatably snapped into a receiving portion of the release button, the mass further comprises a pin that depends outwardly from a pair of opposed surfaces of the mass and is movably received within a pair of openings in the release button and the frame, and further wherein the pair of springs make contact with the pin.

2. The seat belt buckle as in claim 1, wherein the pair of springs are a pair of leaf springs, one of the pair of leaf springs being disposed on one side of the release button and the other one of the pair of leaf springs is disposed on another side of the release button, wherein the frame is disposed within the pair of leaf springs.

3. The seat belt buckle as in claim 2, wherein the pair of leaf springs bias the inertia locking device via the pin into the unblocking position, wherein the unblocking position allows the pin to travel through the pair of openings in the frame as the release button is depressed into the seat belt buckle, wherein the release button causes a force to be applied to the ejector as the release button is depressed into the seat belt buckle and wherein the pin prevents the release button from being depressed into the seat belt buckle when the mass is rotated by a force greater than the biasing force and the inertia locking device is moved from the unblocking position to the blocking position and the pin makes contact with a portion of the frame and prevents movement of the release button.

4. The seat belt buckle as in claim 3, wherein the frame proximate to the pair of openings is configured to provide a cam surface that allows the release button to be depressed into the seat belt buckle in the event of a failure of the pair of leaf springs and more than half of a diameter of the pin is aligned with the pair of openings when the inertia locking device is in the unblocking position.

5. The seat belt buckle as in claim 1, wherein the frame portion is configured to be anchored to a vehicle.

6. The seat belt buckle as in claim 1, wherein the mass has a center of gravity below a pivot point of the mass with respect to the release button, wherein the pivot point is defined by the lobed portion that is rotatably snapped into the receiving portion of the release button.

7. The seat belt buckle as in claim 1, wherein the inertia locking device has a center of gravity below a pivot point of the inertia locking device with respect to the release button, wherein the center of gravity is not aligned with the pivot point of the inertia locking device.

8. A restraint system for a vehicle, comprising:

a seat belt buckle for use with a tongue of a seat belt, the seat belt buckle comprising:

a frame portion;

a latch being movably mounted to the frame portion for movement between a first position and a second position, the latch being configured to engage a portion of the tongue inserted into the frame as the latch moves from the first position to the second position;

an ejector being slidably mounted to the frame portion for movement between a locking position and a release position, wherein movement toward the release position causes an opening force to be applied to the latch in order to move the latch from the second position towards the first position, wherein movement of the ejector towards the release position is caused by movement of a release button movably mounted to the seat belt buckle;

an inertia locking device rotatably mounted to the release button for movement between a blocking position and an unblocking position, the inertia locking device being configured for rotation in a plane substantially parallel to a plane of movement of the latch, wherein a portion of the inertia locking device makes contact with the frame and prevents movement of the release button when the inertia locking device is in the blocking position;

a pair of springs integrally formed with the release button, the pair of springs being configured to provide a biasing force to the inertia locking device to rotate the inertia locking device to the unblocking position; and a pre-tensioning device for removing slack from the seat belt in accordance with a predetermined event;

wherein the inertia locking device comprises a mass rotatably mounted to the release button by a lobed portion that is rotatably snapped into a receiving portion of the release button, the mass further comprising a pin that depends outwardly from a pair of opposed surfaces of the mass and is movably received within a pair of openings in the release button and the frame, and further wherein the pair of springs make contact with the pin.

9. The restraint system as in claim 8, wherein the pair of springs are a pair of leaf springs, one of the pair of leaf springs being disposed on one side of the release button and the other one of the pair of springs is disposed on another side of the release button.

10. The restraint system as in claim 9, wherein the pair of leaf springs bias the inertia locking device via the pin into the unblocking position, wherein the unblocking position allows the pin to travel through the pair of openings in the frame as the release button is depressed into the seat belt buckle, wherein the release button causes a force to be applied to the ejector as the release button is depressed into the seat belt buckle and wherein the pin prevents the release button from being depressed into the seat belt buckle when the mass is rotated by a force greater than the biasing force and the inertia locking device is moved from the unblocking position to the blocking position and the pin makes contact with a portion of the frame and prevents movement of the release button.

11. The restraint system as in claim 10, wherein the frame proximate to the pair of openings is configured to provide a cam surface that allows the release button to be depressed into the seat belt buckle in the event of a failure of the pair of leaf springs and more than half of a diameter of the pin is aligned with the pair of openings when the inertia locking device is in the unblocking position.

12. The restraint system as in claim 8, wherein the frame portion is configured to be anchored to a vehicle.

13. The restraint system as in claim 8, wherein the mass has a center of gravity below a pivot point of the mass with respect to the release button, wherein the pivot point is defined by the lobed portion that is rotatably snapped into the receiving portion of the release button and the center of gravity of the mass is not aligned with the pivot point of the inertia locking device.

14. The restraint system as in claim 8, wherein the inertia locking device has a center of gravity below a pivot point of the inertia locking device with respect to the release button, wherein the center of gravity is not aligned with the pivot point of the inertia locking device.

15. A method for limiting acceleration forces applied to a release mechanism of a seat belt buckle, the method comprising:

rotatably mounting a mass to a release button of the seat belt buckle by inserting a lobed portion into a receiving area of the release button and positioning a pin of the mass into a pair of openings in the release button, the pin being biased in a first position by a pair of springs integrally formed with the release button, wherein the first position allows the pin to travel through a pair of slots in a frame of the seat belt buckle as the release button is slidably moved with respect to the frame from a locked position to an unlocked position wherein the release button causes a force to be applied to an ejector as the release button moves to the unlocked position and wherein the pin prevents movement of the release button from the locked position to the unlocked position when the mass is rotated from the first position and the pin makes contact with a surface of the frame;

wherein the pair of springs are a pair of leaf springs, one of the pair of leaf springs being disposed on one side of the release button and the other one of the pair of springs is disposed on another side of the release button and wherein the mass has a center of gravity below a pivot point of the mass with respect to the release button, wherein the pivot point is defined by the lobed portion that is rotatably snapped into the receiving portion of the release button.

16. The method as in claim 15, wherein an acceleration force for moving the mass from the first position is less than an acceleration force for moving the release button from the locked position to the unlocked position.

* * * * *